US008202121B2

(12) United States Patent
Nichols

(10) Patent No.: US 8,202,121 B2
(45) Date of Patent: Jun. 19, 2012

(54) PRESS FIT CABLE CONNECTOR

(75) Inventor: Robert Paul Nichols, Santa Rosa, CA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/889,173

(22) Filed: Sep. 23, 2010

(65) Prior Publication Data

US 2012/0077381 A1 Mar. 29, 2012

(51) Int. Cl.
*H01R 13/648* (2006.01)

(52) U.S. Cl. ..... 439/607.35

(58) Field of Classification Search ..... 439/607.41, 439/607.46, 607.5, 607.8, 607.1, 579, 76.1, 439/497, 63
See application file for complete search history.

(56) References Cited

U.S. PATENT DOCUMENTS

| | | | | |
|---|---|---|---|---|
| 2,816,275 | A * | 12/1957 | Hammell | 439/850 |
| 3,643,201 | A * | 2/1972 | Harwood | 439/65 |
| 4,737,124 | A * | 4/1988 | Ezure et al. | 439/607.41 |
| 6,068,502 | A * | 5/2000 | Kuo | 439/353 |
| 6,776,621 | B1 | 8/2004 | Dye | |
| 6,808,395 | B2 * | 10/2004 | Lin et al. | 439/63 |
| 7,491,087 | B2 | 2/2009 | Swantner et al. | |
| 7,749,020 | B1 * | 7/2010 | Chang | 439/567 |

* cited by examiner

*Primary Examiner* — Phuong Dinh

(57) ABSTRACT

A connector includes signal pins having a mating end and a wire end. The wire end is configured to be electrically coupled to a wire of a cable. The mating end is configured to be inserted into a via of a substrate. A pin retainer is provided having apertures emending therethrough. The signal pins are inserted through the apertures of the pin retainer such that the mating ends of the signal pins extend from the pin retainer. A ground frame is provided having a wire end and a mating end. An opening extends between the wire end and the mating end. The pin retainer is positioned within the opening of the ground frame such that the mating ends of the signal pins extend from the mating end of the ground frame. The wire end of the ground frame is configured to contact a shield of the cable.

18 Claims, 7 Drawing Sheets

PRESS FIT CABLE CONNECTOR

BACKGROUND OF THE INVENTION

The subject matter described herein relates to cable connectors and, more particularly, to a press fit cable connector.

Electronic devices typically include circuit board assemblies including a circuit board having a plurality of headers. The headers include a mating end configured to receive modules, cards, or the like. The modules and cards are joined to the header to provide various functions to the electronic device. For example, the modules and cards may provide power and/or process data for the electronic device. Many modules and cards require data and/or power signals from peripheral devices and/or circuit board assemblies. Accordingly, the peripheral devices are coupled to the circuit board to communicate with the cards and modules. Often a cable of the peripheral device is electrically coupled to the circuit board to allow power and/or data signals to be conveyed between the circuit board assembly and the peripheral device.

However, conventional circuit board assemblies are not without their disadvantages. Generally, the cable of the peripheral device is joined to the circuit board. The cable communicates with the headers through signal traces provided in the circuit board. Joining the cable to the circuit board requires connectors to be surface mounted to the circuit board or the cable signals to be routed into the board through vias. Optionally, wires from the cable may be soldered and/or otherwise joined to the circuit board. Providing connectors and/or soldering the cable to the circuit board utilizes a substantial amount of the circuit board surface. The signal traces provided in the circuit board likewise consume a substantial amount of the circuit board surface. Accordingly, the number of components that may be joined to the circuit board is limited. Moreover, the soldered wires and the connectors are generally permanent. As such, the circuit board may not be reconfigurable.

A need remains for a cable that can be directly and removably joined to the header of a circuit board.

SUMMARY OF THE INVENTION

In one embodiment, a connector for a cable is provided. The connector includes signal pins having a mating end and a wire end. The wire end is configured to be electrically coupled to a wire of a cable. The mating end is configured to be inserted into a via of a substrate. A pin retainer is provided having apertures extending therethrough. The signal pins are inserted through the apertures of the pin retainer such that the mating ends of the signal pins extend from the pin retainer. A ground frame is provided having a wire end and a mating end. An opening extends between the wire end and the mating end. The pin retainer is positioned within the opening of the ground frame such that the mating ends of the signal pins extend from the mating end of the ground frame. The wire end of the ground frame is configured to contact a shield of the cable.

In another embodiment, a cable assembly is provided. The assembly includes a cable configured to be coupled to a substrate. The cable has wires. Signal pins are provided having a mating end and a wire end. The wire end of each signal pin is electrically coupled to a wire of a cable. The mating end is configured to be inserted into a via of a substrate. A pin retainer is provided having apertures extending therethrough. The signal pins are inserted through the apertures of the pin retainer such that the mating ends of the signal pins extend from the pin retainer. A ground frame is provided having a wire end and a mating end. An opening extends between the wire end and the mating end. The pin retainer is positioned within the opening of the ground frame such that the mating ends of the signal pins extend from the mating end of the ground frame. The wire end of the ground frame is configured to contact a shield of the cable.

In another embodiment, a connector for a cable is provided. The connector includes signal pins having a mating end and a wire end. The wire end is configured to be electrically coupled to a wire of a cable. The mating end is configured to be inserted into a via of a substrate. A pin retainer is provided having a wire end a mating end. Apertures extending through the pin retainer from the wire end to the mating end. The signal pins are inserted through the apertures of the pin retainer such that the mating ends of the signal pins extend from the mating end of the pin retainer. A ground frame is provided having a wire end and a mating end. An opening extends between the wire end and the mating end. The pin retainer is positioned within the opening of the ground frame such that the mating ends of the signal pins extend from the mating end of the ground frame. The wire end of the ground frame is configured to contact a shield of the cable. A ground pin is coupled to and positioned radially outward from the ground frame. The ground pin is configured to be inserted into a via of the substrate.

DETAILED DESCRIPTION OF THE INVENTION

The foregoing summary, as well as the following detailed description of certain embodiments will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1:
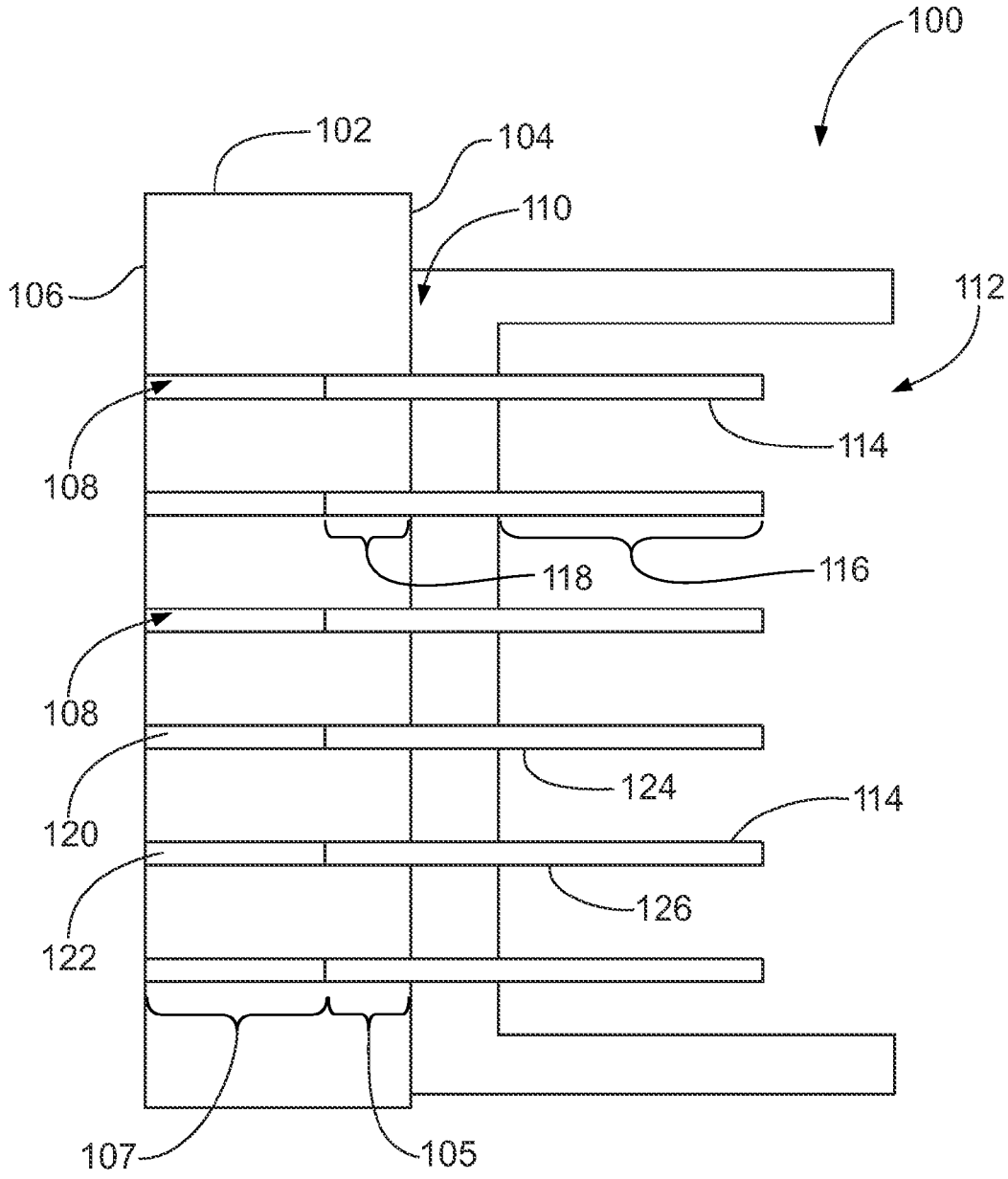
FIG. 1 is a side cross-sectional view of a connector formed in accordance with an embodiment and coupled to a substrate formed in accordance with an embodiment.

FIG. 1 illustrates a connector 100 coupled to a substrate 102. The substrate 102 may be a circuit board, for example, a printed circuit board. The substrate 102 may be a mother card, daughter card, backplane, or the like. The substrate 102 is configured to receive modules (not shown), for example power modules, data modules, network modules, or the like. The substrate 102 includes a mounting surface 104 and a bottom surface 106 that is opposite the mounting surface 104. The mounting surface 104 is configured to receive the modules thereon. The modules may be press-fit and/or surface mounted to the mounting surface 104. In the illustrated embodiment, the substrate 102 has vias 108 extending therethrough. The vias 108 extend from the mounting surface 104 to the bottom surface 106. The vias 108 include a mounting end 105 and a bottom end 107. The vias 108 may be metal plated to convey electrical currents, for example, data and/or power signals. The vias 108 may be electrically coupled to signal traces within the substrate 102. The vias 108 include ground vias 120 and signal vias 122.

The connector 100 is configured to be coupled to a module. In one embodiment, the connector 100 is configured as a header. The connector 100 includes a mounting end 110 and a mating end 112. The mating end 112 is configured to couple to a module. The mounting end 110 is configured to be joined to the substrate 102. A plurality of contacts 114 extend between the mounting end 110 and the mating end 112 of the connector 100. The contacts 114 include ground contacts 124 and signal contacts 126. Each contact 114 includes a mating end 116 and a mounting end 118. The mating end 116 of each contact 114 extends from the mating end 112 of the connector 100. The mating end 116 is configured to engage a corresponding contact of the module. The mounting end 118 of each contact 114 extends from the mounting end 110 of the connector 100. The mounting end 118 of each contact 114 is received within a via 108 of the substrate 102 to electrically couple the connector 100 to the substrate 102. The mounting end 118 of the ground contacts 124 are received within ground vias 120. And the mounting end 118 of the signal contacts 126 are received within signal vias 122. In an exemplary embodiment, the contacts 114 are partially received within the vias 108. The contacts 114 may be received only in the mounting end 105 of the via 108 such that the bottom end 107 of the via 108 remains open and capable of receiving a contact, pin, or the like. It should be noted that the ground vias 120 and signal vias 122 may be arranged in any configuration that corresponds to the arrangement of the ground contacts 124 and the signal contacts 126.

Figure 2:
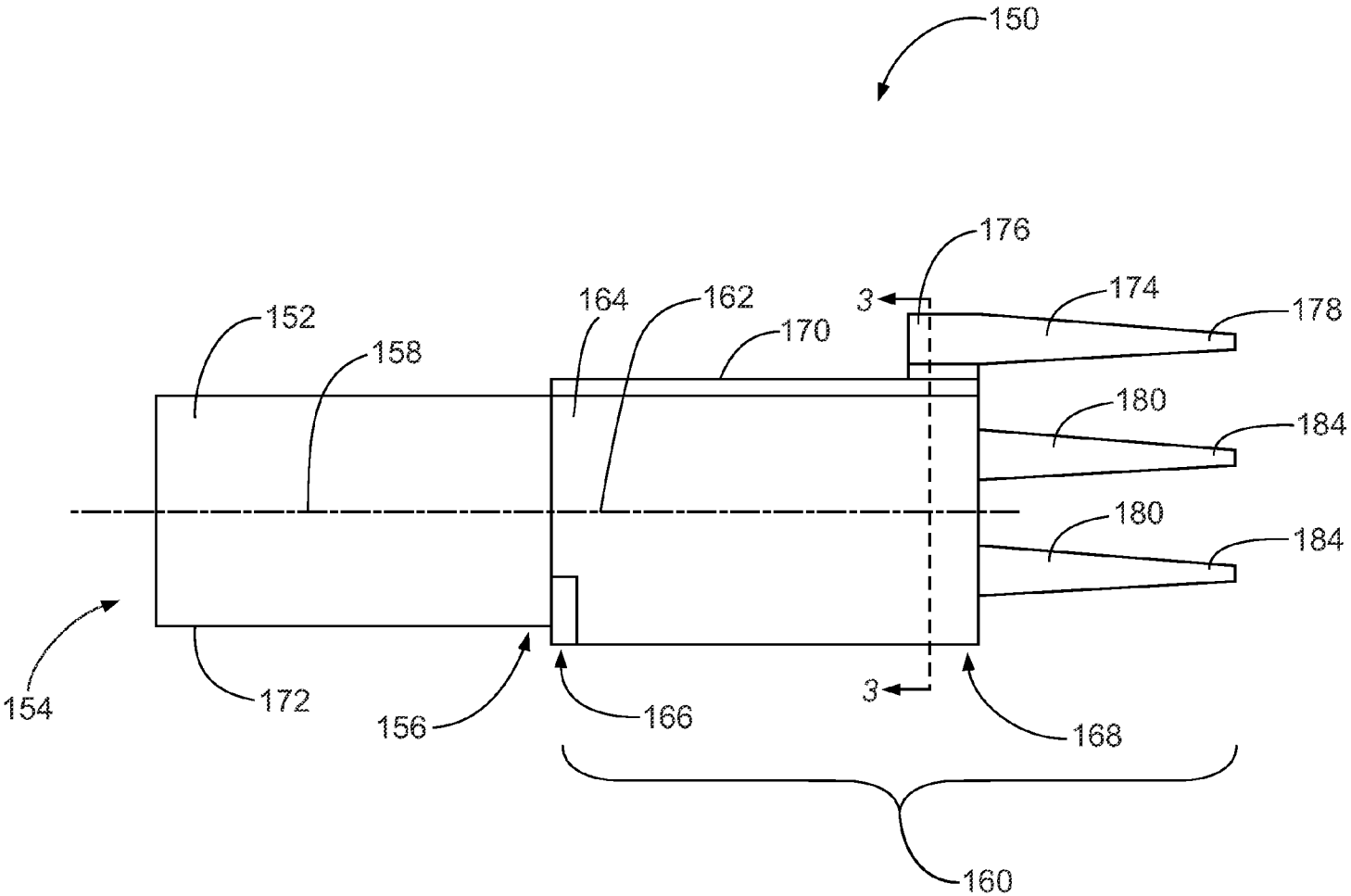
FIG. 2 is a side view of a cable assembly formed in accordance with an embodiment.

FIG. 2 illustrates a cable assembly 150 formed in accordance with an embodiment and configured to be coupled to the substrate 102 (shown in FIG. 1). The cable assembly 150 includes a cable 152 having a device end 154 and a mating end 156. The device end 154 is configured to be coupled to a peripheral device, for example, an electronic device, a substrate, or the like. The cable 152 has an axis 158 extending from the device end 154 to the mating end 156.

A connector 160 is joined to the mating end 156 of the cable 152. The connector 160 has an axis 162 extending therethrough. The connector 160 is axially joined to the cable 152. The axis 162 of the connector 160 is aligned with the axis 158 of the cable 152. The connector 160 includes a ground frame 164 joined to the mating end 156 of the cable 152. The ground frame 164 includes a wire end 166 and a mating end 168. The wire end 166 of the ground frame 164 is joined to the mating end 156 of the cable 152. The ground frame 164 extends axially from the mating end 156 of the cable 152. The wire end 166 of the ground frame 164 is configured to join to a shield/drain wire 165 (shown in FIG. 3) of the cable 152. The mating end 168 of the ground frame 164 is configured to be coupled to the substrate 102.

The axis 162 of the connector 160 extends through the ground frame 164. The ground frame 164 shares the axis 162 with the connector 160. The ground frame 164 includes an outer surface 170 positioned radially outward from the axis 162. The outer surface 170 of the ground frame 164 extends further outward from the axis 162 than an outer surface 172 of the cable 152 extends outward from the axis 158 of the cable 152. Optionally, the outer surface 170 of the ground frame 164 and the outer surface 172 of the cable 152 may extend any suitable distance from the respective axis 162 and 158.

A ground pin 174 is joined to the ground frame 164. The ground pin 174 includes a wire end 176 and a mating end 178. The wire end 176 of the ground pin is joined to the ground frame 164. The ground pin 174 is in electrical communication with the ground frame 164 and the shield/drain wire 165 of the cable 152. The ground pin 174 is coupled to the outer surface 170 of the ground frame 164. In one embodiment, the ground pin 174 is formed integrally with the ground frame 164. The ground pin 174 is positioned radially outward from the outer surface 170 of the ground frame 164. The mating end 178 of the ground pin 174 extends from the mating end 168 of the ground frame 164. In the illustrated embodiment, the ground pin 174 extends substantially parallel to the axis 162. Optionally, the ground pin 174 may extend at an angle with respect to the axis 162. The ground pin 174 is configured to be received in the bottom end 107 (shown in FIG. 1) of a ground via 120 (shown in FIG. 1) extending through the substrate 102.

In the illustrated embodiment, the ground pin 174 is tapered inward from the wire end 176 to the mating end 178 of the ground pin 174. The ground pin 174 is tapered to be press-fit in a ground via 120 of the substrate 102. In another embodiment the ground pin 174 is not tapered and is configured to deform to create an interference fit with the ground via 120. Optionally, the ground pin 174 and/or the ground via 120 deform so that the ground pin 174 is fit into the ground via 120. In one embodiment, the ground pin 174 may includes ribs, protrusions, or the like that are configured to deform when the ground pins 174 is inserted into the ground via 120. Alternatively, the ground pin 174 may be a compliant pin.

Signal pins 180 extend from the ground frame 164. The signal pins 180 include a wire end 182 (shown in FIG. 3) and a mating end 184. The wire end 182 is positioned within the ground frame 164. The mating end 184 extends from the mating end 168 of the ground frame 164. The mating end 184 extends substantially parallel to the axis 162 of the ground frame 164. Optionally, the mating end 184 may extend at an angle with respect to the axis 162 of the ground frame 164. The mating end 184 of each signal pin 180 is configured be received in the bottom end 107 (shown in FIG. 1) of a signal via 122 (shown in FIG. 1) extending through the substrate 102.

In the illustrated embodiment, the signal pins 180 are tapered inward from the wire end 182 to the mating end 184 of the signal pin 180. The signal pins 180 are tapered to be press-fit in a signal via 122 of the substrate 102. In another embodiment the signal pins 180 are not tapered and are configured to deform to create an interference fit with the signal vias 122. Optionally, the signal pins 180 and/or the signal vias 122 deform so that the signal pins 180 are fit into the signal via 122. In one embodiment, the signal pins 180 may includes ribs, protrusions, or the like that are configured to deform when the signal pins 180 are inserted into the signal vias 122. Alternatively, the signal pins 180 may be micro-action pins.

Figure 3:
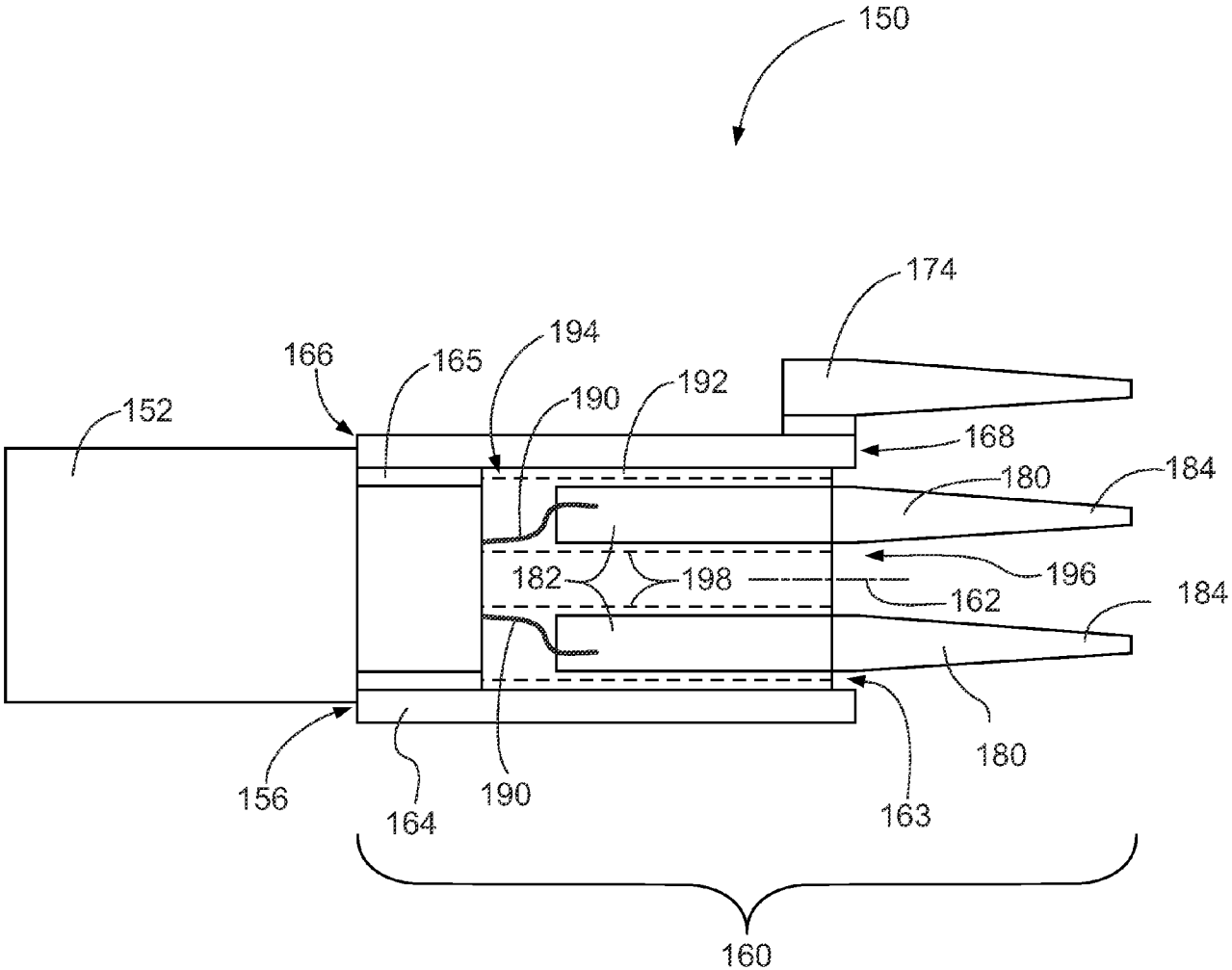
FIG. 3 is a side cross-sectional view of the cable assembly shown in FIG. 2 taken about the line 3-3 shown in FIG. 2.

FIG. 3 illustrates the cable assembly 150 taken, about the line 3-3 shown in FIG. 2. The mating end 156 of the cable 152 is stripped to expose the shield/drain wire 165 and wires 190. The ground frame 164 is positioned around the mating end 156 of the cable 152. In one embodiment, the ground frame 164 is axially slid into position over the cable 152. Optionally, the ground frame 164 may be crimped around the cable 152. The wire end 166 of the ground frame 164 abuts the shield/ drain wire 165 of the cable 152. The wire end 166 of the ground frame 164 is positioned around the shield/drain wire 165. In one embodiment, the ground frame 164 is formed from a conductive material that electrically couples the shield/drain wire 165 to the ground pin 174. Alternatively, the ground frame 164 may be formed from an insulative material having a signal trace extending therethrough. The signal trace electrically couples the shield/drain wire 165 to the ground pin 174.

A pin retainer 192 is positioned within the ground frame 164. The pin retainer 192 is positioned within an opening 163 extending between the wire end 166 and the mating end 168 of the ground frame 164. The pin retainer 192 shares the axis 162 with the ground frame 164 and the connector 160. In one embodiment, the ground frame 164 is axially slid over the pin retainer 192. Optionally, the ground frame 164 may be crimped to the pin retainer 192. The pin retainer 192 includes a wire end 194 and a mating end 196. The wire end 194 of the pin retainer 192 abuts the mating end 156 of the cable 152. The wire end 194 of the pin retainer 192 abuts the shield/drain wire 165 of the cable 152. The mating end 196 of the pin retainer 192 is positioned proximate to the mating end 168 of the ground frame 164.

The pin retainer 192 includes apertures 198 extending therethrough. The signal pins 180 are positioned within the apertures 198. The pin retainer 192 retains the signal pins 180 in position. The wire ends 182 of the signal pins 180 are positioned at an intermediate location between the wire end 194 and the mating end 196 of the pin retainer 192. Optionally, the wire ends 182 of the signal pins 180 may be positioned proximate to the wire end 194 of the pin retainer 192. The mating ends 184 of the signal pins 180 extend from the mating end 196 of the pin retainer 192. The signal pins 180 extend substantially parallel to the axis 162.

The wire ends 182 of the signal pins 180 are joined to the wires 190 of the cable 152. In one embodiment, the wires 190 of the cable 152 are soldered, welded, and/or otherwise adhered to the signal pins 180. In another embodiment, the wire ends 182 of the signal pins 180 include a slot and/or aperture configured to receive the wires 190 of the cable 152. The signal pins 180 are electrically coupled to the wires 190 of the cable 152. In an exemplary embodiment, the pin retainer 192 is formed from an insulative material, for example, plastic and/or rubber that insulates the ground frame 164 from the signal pins 180.

The cable assembly 150 is configured to be coupled to the bottom 106 (shown in FIG. 1) of the substrate 102 (shown in FIG. 1) such that the signal pins 180 are received in signal vias 122 (shown in FIG. 1) and the ground pin 174 is received in a ground via 120 (shown in FIG. 1). The vias 108 (shown in FIG. 1) electrically couple the cable 152 to the connector 100 (shown in FIG. 1). The cable assembly 150 enables the cable 152 to be removably coupled to the connector 100 without utilizing space on the substrate 102 and/or requiring multiple signal traces within the substrate 102. Connecting the cable 152 directly to the substrate 102 improves the integrity of signals conveyed between the cable 152 and the substrate 102. In one embodiment, the cable assembly 150 may have any number of signal pins 180 and ground pins 174 that corresponds to the connector 100. Alternatively, the connector 100 may be configured to receive any number of cables 152. In one embodiment, the ground frame 164 is configured to receive any number of cables 152. In such an embodiment, the ground frame 164 may include a ground pin 174 for each cable 152 coupled thereto. Optionally, the ground frame 164 may include a single ground pin 174 that is common to any number of cables 152 joined to the ground frame 164. In another embodiment, several ground frames 164 may be joined together to form a single cable assembly 150.

Figure 4:
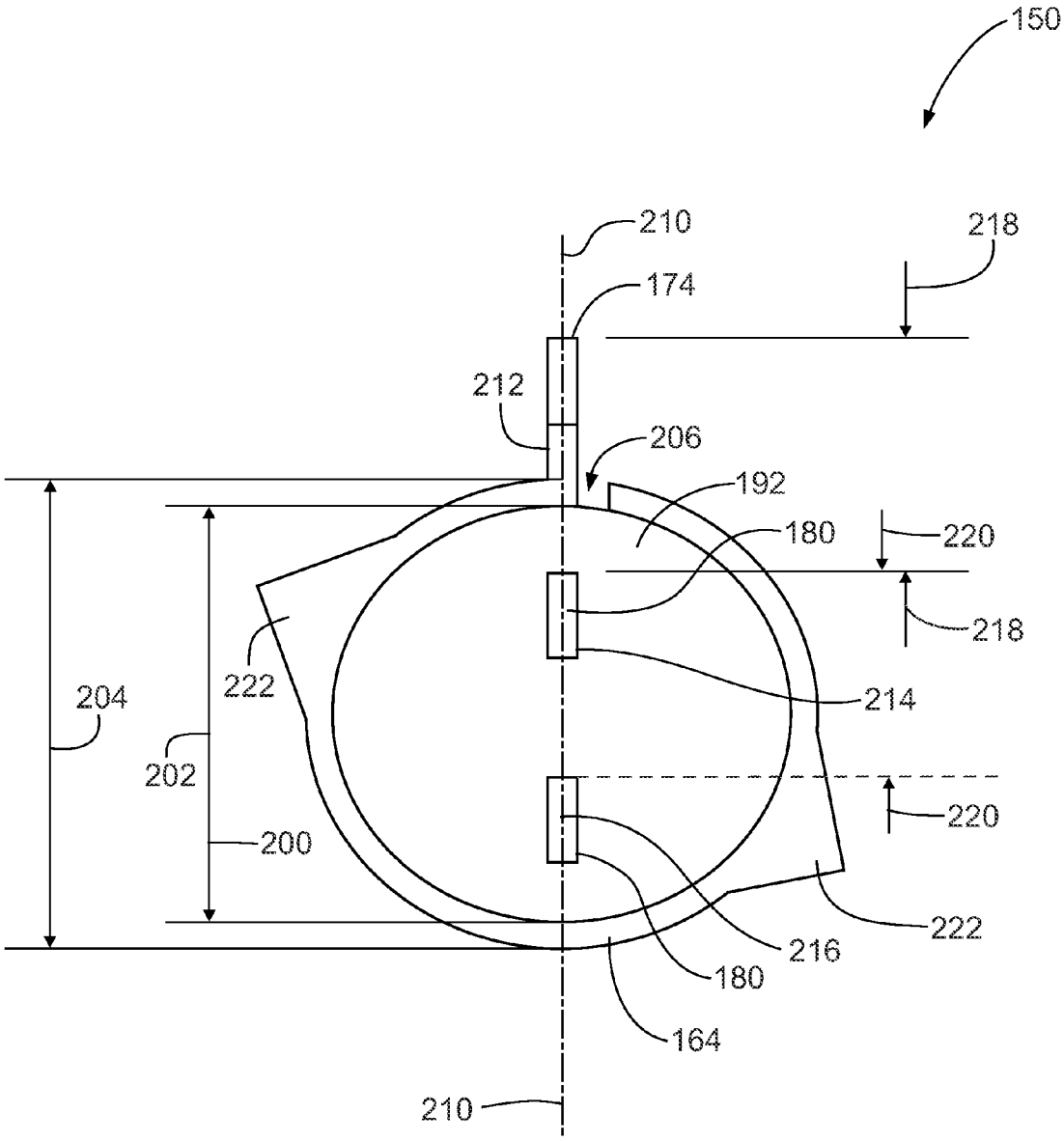
FIG. 4 is a front view of the cable assembly shown in FIG. 2.

FIG. 4 illustrates a front view of the cable assembly 150 (shown in FIG. 3). The pin retainer 192 is positioned within the ground frame 164. The pin retainer 192 includes a diameter 200. The ground frame 164 includes an inner diameter 202 and an outer diameter 204. In one embodiment, the inner diameter 202 of the ground frame 164 is slightly less than the outer diameter 200 of the pin retainer 192. In such an embodiment, the ground frame 164 is retained on the pin retainer 192 through an interference fit. In the illustrated embodiment, the ground frame 164 includes a notch 206. The notch 206 provides flexibility to the ground frame 164. The ground frame 164 may be formed with an inner diameter 202 that is less than the outer diameter 200 of the pin retainer 192. The notch 206 allows the ground frame 164 to bend so that the ground frame 164 can be fit over the pin retainer 192. Optionally, the ground frame 164 does not include a notch 206 and the inner diameter 202 of the ground frame 164 is sized to the outer diameter 200 of the pin retainer 192. In another embodiment, the ground frame 164 is formed with an inner diameter 202 that is greater than the outer diameter 200 of the pin retainer 192. In such an embodiment, the ground frame 164 is crimped into contact with the pin retainer 192. Optionally, the ground frame 164 and the pin retainer 192 may be formed integrally.

A plane 210 is defined by the diameter 200 of the pin retainer 192. The ground frame 164 includes a pin flange 212 extending radially therefrom. The pin flange 212 is aligned with the plane 210. The ground pin 174 is joined to the pin flange 212 and aligned with the plane 210. The signal pins 180 are positioned within the pin retainer 192 and aligned with the plane 210. The signal pins 180 and the ground pin 174 are aligned along the plane 210. Optionally, the ground pin 174 and the signal pins 180 may be offset from one another. In one embodiment, the cable assembly 150 may include several signal pins 180 and/or ground pins 174 extending along various different planes 210.

The signal pins 180 include a top signal pin 214 and a bottom signal pin 216. The top signal pin 214 is positioned from the ground pin 174 with a pitch 218. The top signal pin 214 is positioned from the bottom signal pin 216 with a pitch 220. The pitch 218 may be substantially equal to the pitch 220. Alternatively, the pitch 218 may be different than the pitch 220. The pitches 218 and 220 are selected based on a pitch of the vias 108 (shown in FIG. 1) of the substrate 102 (shown in FIG. 1). The pitches 218 and 220 are selectable to accommodate the pitch of the vias 108.

In the illustrated embodiment, the ground frame 164 includes flanges 222. The flanges 222 extend radially outward from the ground frame 164. The illustrated embodiment includes two flanges 222. The flanges 222 are positioned 180 degrees apart around the circumference of the ground frame 164. Optionally, the ground frame 164 may include any number of flanges 222. The flanges 222 may be positioned at any intervals around the circumference of the ground frame 164. In one embodiment, the ground frame 164 may include a flange extending entirely around the circumference thereof. The flanges 222 provided a pressing surface to press fit the cable assembly 150 into the substrate 102. The flanges 222 enable the cable assembly 150 to be inserted into the substrate 102 without dislodging the wires 190, the ground frame 164, and/or the pin retainer 192.

Figure 5:
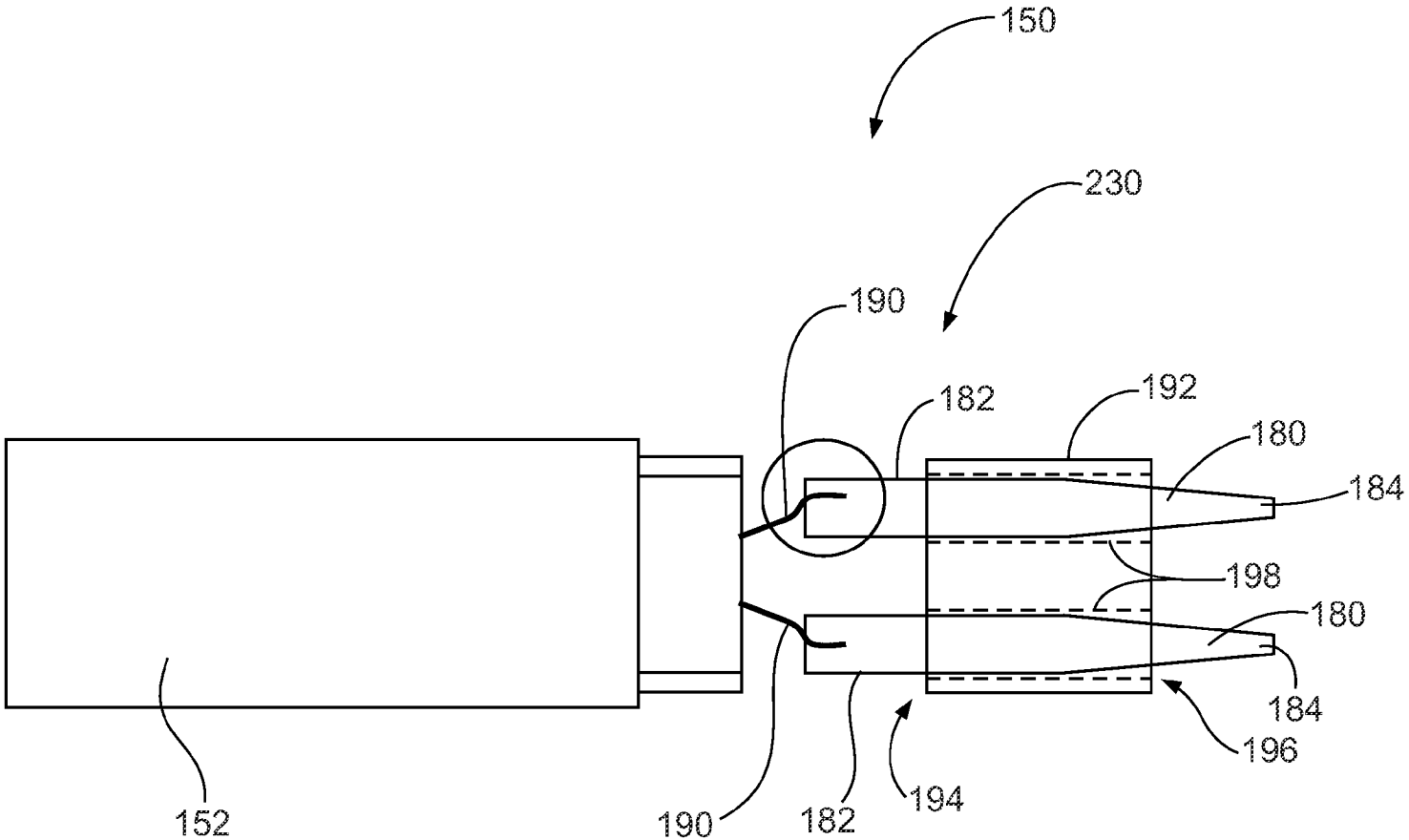
FIG. 5 is a side cross-sectional view of the cable assembly shown in FIG. 2 and in a loading position.

FIG. 5 illustrates the cable assembly 150 in a loading position 230. FIG. 5 illustrates the cable assembly 150 without the ground frame 164. The signal pins 180 are inserted into the pin retainer 192. The signal pins 180 are held within the apertures 198 of the pin retainer 192. In one embodiment, the signal pins 180 are retained within the apertures 198 through an interference fit. In one embodiment, the signal pins 180 may deform to create an interference fit with the apertures 198. In another embodiment, the apertures 198 may deform to receive the signal pins 180. Alternatively, the signal pins 180 and the apertures 198 may both deform to create an interference fit. In an exemplary embodiment, the signal pins 180 are retained within the apertures 198 yet moveable with force through the apertures 198 such that the pin retainer 192 slides along the signal pins 180 under force.

In the loading position 230 the wire ends 182 of the signal pins 180 extend from the wire end 194 of the pin retainer 192. In the illustrated embodiment, the mating ends 184 of the signal pins 180 extend from the mating end 196 of the pin retainer 192. In another embodiment, the mating ends 184 of the signal pins 180 may be positioned within the pin retainer 192 in the loading position 230. The wire ends 182 of the signal pins 180 are exposed to allow the wires 190 to be coupled thereto. In one embodiment, the wires 190 are soldered, welded, or otherwise adhered to the signal pins 180. Alternatively, the wires 190 may be inserted into slots and/or apertures formed in the signal pins 180. In one embodiment, the wires 190 may be inserted into an aperture and/or slot of the signal pin 180 and then soldered or otherwise adhered thereto. The wires 190 are joined to the signal pins 180 to electrically couple the cable 152 and the signal pins 180. Electrical signals, for example, data and/or power signals are conveyed between the wires 190 and the signal pins 180.

In an exemplary embodiment, the signal pins 180 are first loaded into the pin retainer 192. The wires 190 are then coupled to the signal pins 180. Alternatively, the wires 190 may first be joined to the signal pins 180. The signal pins 180 may then be inserted into the pin retainer 192.

Figure 6:
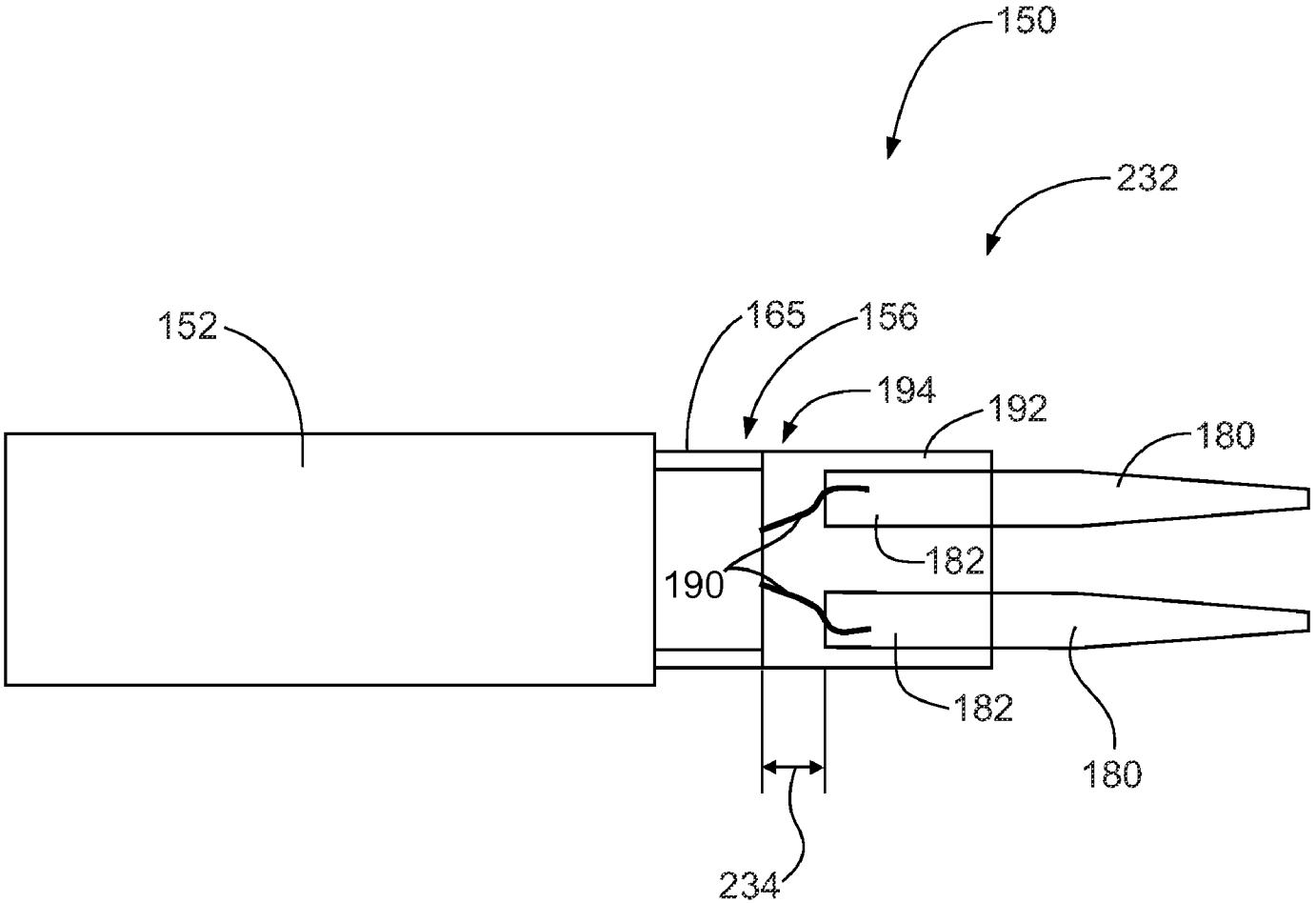
FIG. 6 is a side cross-sectional view of the cable assembly shown in FIG. 2 and in an assembled position.

FIG. 6 illustrates the cable assembly 150 in an assembled position 232. FIG. 6 illustrates the cable assembly 150 without the ground frame 164. In the assembled position, the pin retainer 192 is slid into contact with the mating end 156 of the cable 152. The pin retainer 192 is slid along the signal pins 180 such that the wire ends 182 of the signal pins 180 are positioned within the pin retainer 192. The wire ends 182 of the signal pins 180 are slid into a position that is a distance 234 from the wire end 194 of the pin retainer 192. The wires 190 are received in the pin retainer 192. The wires 190 extend through the pin retainer 192 between the mating end 156 of the cable 152 and the wire ends 182 of the signal pins 180. In another embodiment, the wire ends 182 of the signal pins 180 are positioned proximate to the wire end 194 of the pin retainer 192. In one embodiment the wire ends 182 of the signal pins 180 may be flush with the wire end 194 of the pin retainer 192.

The wire end 194 of the pin retainer 192 abuts the mating end 156 of the cable 152. The wire end 194 of the pin retainer 192 abuts the shield/drain wire 165 of the cable 152. The pin retainer 192 is formed from an insulative material. The pin retainer 192 insulates the shield/drain wire 165 of the cable 152 from the wires 190 of the cable 152 and the signal pins 180.

In the assembled position 232, the cable assembly 150 is configured to be received within the ground frame 164 (shown in FIG. 3). In one embodiment, the cable assembly 150 is individually joined to a ground frame 164. In another embodiment, several cable assemblies 150 are received in a single ground frame 164. The ground frame 164 contacts the shield/drain wire 165 of the cable 152 to electrically connect the ground pin 174 and the cable 152.

Figure 7:
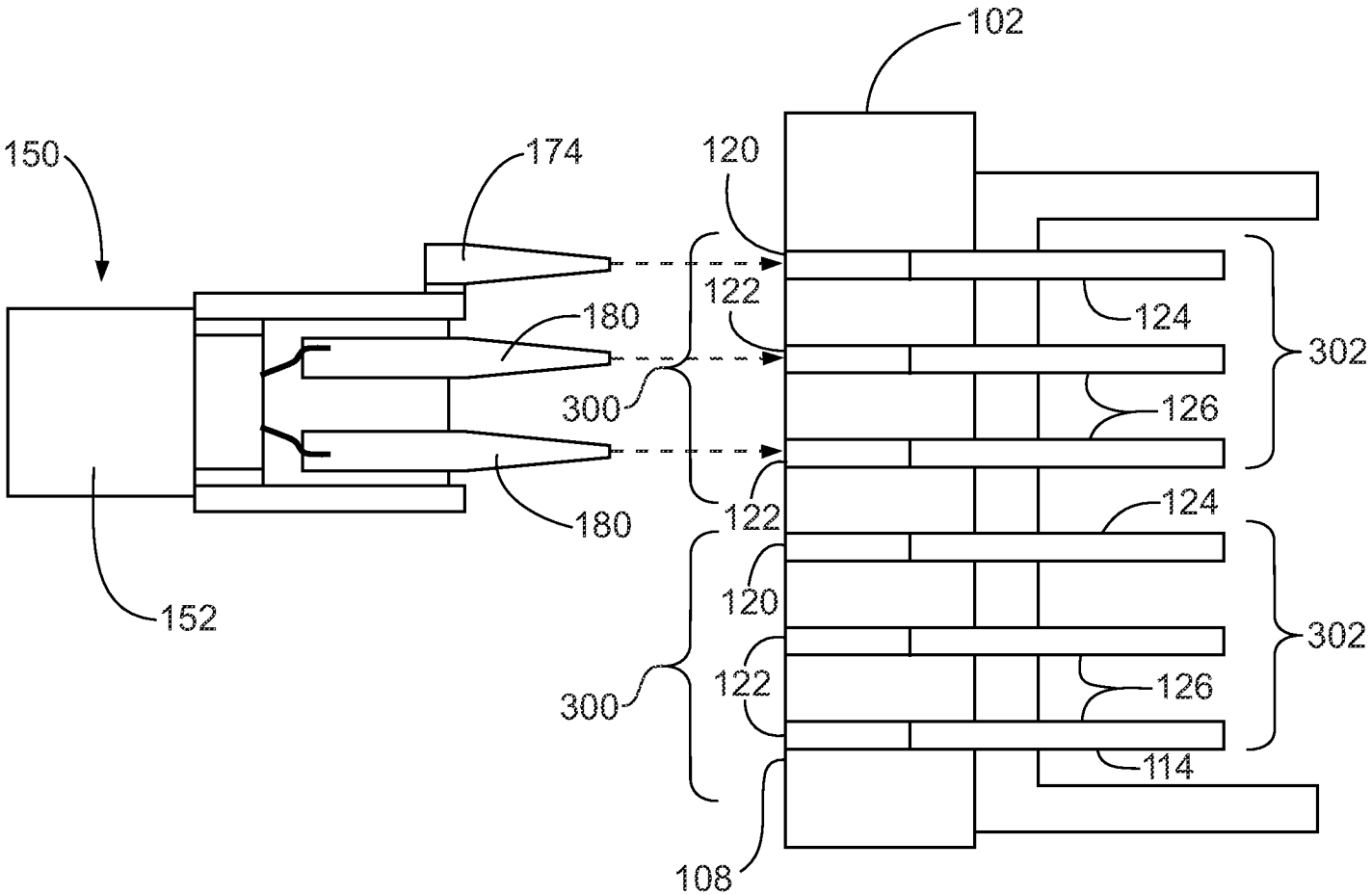
FIG. 7 illustrates a cable assembly formed in accordance with an embodiment and being inserted into a substrate formed in accordance with an embodiment.

FIG. 7 illustrates a cable assembly 150 being inserted into the substrate 102. The substrate 102 includes two groups 300 of vias 108. Each group 300 includes a ground via 120 and a pair of signal vias 122. Each group 300 of vias 108 is configured to receive a cable assembly 150. The illustrated substrate 102 is configured to receive two cable assemblies 150. Alternatively, the substrate 102 may be configured to receive any number of cable assemblies 150.

The connector 100 includes two groups 302 of contacts 114. Each group of contacts 114 includes a ground contact 124 and a pair of signal contacts 126. The ground contacts 124 are received in a ground via 120 and the signal contacts 126 are received in signal vias 122.

The ground pin 174 of the cable assembly 150 is configured to be received in a ground via 120. The ground pin 174 is electrically coupled to the ground contact 124 of the connector 100. The signal pins 180 of the cable assembly 150 are configured to be received in signal vias 122. The signal pins 180 of the cable assembly 150 are electrically coupled to the signal contacts 126 of the connector 100.

The substrate 102 is configured to receive at least one cable assembly 150 to electrically couple the cable 152 of a peripheral device to the connector 100. Electrical signals, for example, data and/or power signals are conveyed between the peripheral device and the connector 100 via the cable assembly 150 and the substrate 102. The cable assembly 150 enables the cable 152 to be directly coupled to the connector 100. The cable assembly 150 improves signal integrity between the peripheral device and the connector 100. The cable assembly 150 reduces a footprint on the substrate 102 and eliminates the need for many of the signal traces in the substrate 102.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A connector for a cable comprising:

signal pins arranged as a pair with the signal pins carrying differential signals, each of the signal pins having a mating end and a wire end, the wire end configured to be electrically coupled to a wire of the cable, the mating end configured to be inserted into a via of a substrate;

a pin retainer having apertures extending therethrough, the pair of signal pins inserted through the apertures of the pin retainer such that the mating ends of the signal pins extend from the pin retainer; and a ground frame having a wire end and a mating end, an opening extending between the wire end and the mating end, the pin retainer positioned within the opening of the ground frame such that the mating ends of the signal pins extend from the mating end of the ground frame, the wire end of the ground frame configured to contact a shield of the cable, wherein the ground frame includes a ground pin extending from the mating end of the ground frame, the ground pin configured to be inserted into a via of the substrate.

2. The connector of claim 1, wherein the pin retainer is movable with respect to the signal pins between a loading position wherein the wires of the cable are joined to the signal pins and an assembled position wherein the pin retainer is configured to be inserted into the ground frame.

3. The connector of claim 1, wherein the mating ends of the signal pins are tapered and configured to be press-fit into the vias of the substrate.

4. The connector of claim 1, wherein the ground frame includes a flange to provide a pressing surface for joining the connector to the substrate.

5. The connector of claim 1, wherein a pitch between the signal pins is variable to accommodate a pitch of the vias on the substrate.

6. The connector of claim 1, wherein the ground frame is positioned radially outward of the pair of signal pins and surrounds the pair of signal pins to provide shielding for the pair of signal pins, the ground pin positioned radially outward from the ground frame.

7. The connector of claim 1, wherein the signal pins extend parallel to an axis of the pin retainer, the signal pins being off-set with respect to a center of the pin retainer.

8. The connector of claim 1, wherein the signal pins are aligned along a diameter of the pin retainer, the signal pins being off-set with respect to a center of the pin retainer.

9. A cable assembly comprising:

a cable configured to be coupled to a substrate, the cable having a pair of wires carrying differential signals;

signal pins arranged as a pair with the signal pins carrying differential signals, each of the signal pins having a mating end and a wire end, the wire end of each signal pin electrically coupled to one of the wires of the cable, the mating end configured to be inserted into a via of a substrate;

a pin retainer having apertures extending therethrough, the signal pins inserted through the apertures of the pin retainer such that the mating ends of the signal pins extend from the pin retainer; and a ground frame having a wire end and a mating end, an opening extending between the wire end and the mating end, the pin retainer positioned within the opening of the ground frame such that the mating ends of the signal pins extend from the mating end of the ground frame, the wire end of the ground frame configured to contact a shield of the cable, wherein the ground frame includes a ground pin extending from the mating end of the ground frame, the ground pin configured to be inserted into a via of the substrate.

10. The cable assembly of claim 9, wherein the pin retainer is movable with respect to the signal pins between a loading position wherein the wires of the cable are joined to the signal pins and an assembled position wherein the pin retainer is configured to be inserted into the ground frame.

11. The cable assembly of claim 9, wherein the ground frame includes a flange to provide a pressing surface for joining the connector to the substrate.

12. The cable assembly of claim 9, wherein a pitch between the signal pins is variable to accommodate a pitch of the vias on the substrate.

13. The cable assembly of claim 9, wherein the ground pin is positioned radially outward from the ground frame.

14. The cable assembly of claim 9, wherein the signal pins are aligned along a diameter of the pin retainer, the signal pins being off-set with respect to a center of the pin retainer.

15. A connector for a cable comprising:

signal pins having a mating end and a wire end, the wire end configured to be electrically coupled to a wire of the cable, the mating end configured to be press-fit into a via of a substrate to mechanically and electrically connect the mating end to the via by an interference therebetween;

a pin retainer having a wire end a mating end, apertures extending through the pin retainer from the wire end to the mating end, the signal pins inserted through the apertures of the pin retainer such that the mating ends of the signal pins extend from the mating end of the pin retainer;

a ground frame having a wire end and a mating end, an opening extending between the wire end and the mating end, the pin retainer positioned within the opening of the ground frame such that the mating ends of the signal pins extend from the mating end of the ground frame, the wire end of the ground frame configured to contact a shield of the cable; and a ground pin coupled to and positioned radially outward from the ground frame, the ground pin configured to be press-fit into a via of the substrate to mechanically and electrically connect the mating end to the via by an interference therebetween.

16. The connector of claim 15, wherein the signal retainer is movable with respect to the signal pins between a loading position wherein the wires of the cable are joined to the signal pins and an assembled position wherein the pin retainer is configured to be inserted into the ground frame.

17. The connector of claim 15, wherein the signal pins extend parallel to an axis of the pin retainer and are aligned along a diameter of the pin retainer, the signal pins being off-set with respect to a center of the pin retainer.

18. The connector of claim 15, wherein the signal pins are arranged as a pair with the signal pins of the pair carrying differential signals.

* * * * *